United States Patent [19]

Matsumoto et al.

[11] 4,191,140

[45] Mar. 4, 1980

[54] INDUCTION FLOW GUIDE DEVICE FOR INTERNAL COMBUSTION ENGINE INTAKE MANIFOLD

[75] Inventors: Hiromitsu Matsumoto; Toshio Kurahashi, both of Hamamatsu, Japan

[73] Assignee: Yamaha Hatsudoki Kabushiki Kaisha, Iwata, Japan

[21] Appl. No.: 883,825

[22] Filed: Mar. 6, 1978

[51] Int. Cl.[2] ..... F02B 75/18

[52] U.S. Cl. ..... 123/52 MB; 123/141

[58] Field of Search ..... 123/141, 52 M, 52 MB, 123/52 MC

[56] References Cited

U.S. PATENT DOCUMENTS

| | | | |
|---|---|---|---|
| 1,793,509 | 2/1931 | Purdy | 123/52 M |
| 2,609,280 | 9/1952 | Cremean | 123/141 |
| 2,966,150 | 12/1960 | Wiltshire et al. | 123/52 M |
| 3,393,984 | 7/1968 | Wisman | 123/141 |
| 3,968,780 | 7/1976 | Konomi et al. | 123/141 |
| 4,019,483 | 4/1977 | Konomi et al. | 123/141 |

*Primary Examiner*—Ira S. Lazarus

*Attorney, Agent, or Firm*—Donald D. Mon

[57] ABSTRACT

A rectifying plate is fitted in the intake manifold of an internal combustion engine between the carburetor primary and secondary intake passages. The primary intake passage is closer to the engine cylinders than the secondary intake passage, and the rectifying plate encourages uniformity of flow rates and richness of mixture to the various cylinders by reducing flow to the closer cylinders and encouraging it to the farther cylinders.

2 Claims, 3 Drawing Figures

INDUCTION FLOW GUIDE DEVICE FOR INTERNAL COMBUSTION ENGINE INTAKE MANIFOLD

The present invention relates to an induction flow guide device for use in internal combustion engines to supply a plurality of cylinders with air/fuel mixture from a single compound carburetor with ain improved uniformity of air/fuel ratio from cylinder to cylinder.

In order to obtain smooth operation of an internal combustion engine that has a plurality of cylinders e.g. a tandem four cylinders engine, it is necessary to equalize the air/fuel ratios and flow rates of mixtures among the respective cylinders. When the cylinders are supplied with mixture from a carburetor having a primary passage located at a side of the carburetor closer to the cylinders, problems of non-equality can result.

As a matter of fact, the cylinders located closer to the carburetor are apt to be supplied with larger amounts of mixture of greater richness than the cylinders located remote from the carburetor, due to the smaller length of the branch pipes and correspondingly decreased flow resistance.

Under this circumstance, the present invention has as an objective to provide an induction flow guide device in which a rectifying plate is provided near the floor of the intake manifold close to the carburetor. The rectifying plate projects from a wall separating the primary and secondary passages of the carburetor, so as to deflect the flow of mixture, thereby to provide a uniform mixture distribution to all cylinders.

The above and other features of this invention will be fully understood from the following detailed description and the accompanying drawings, in which.

Figure 1:
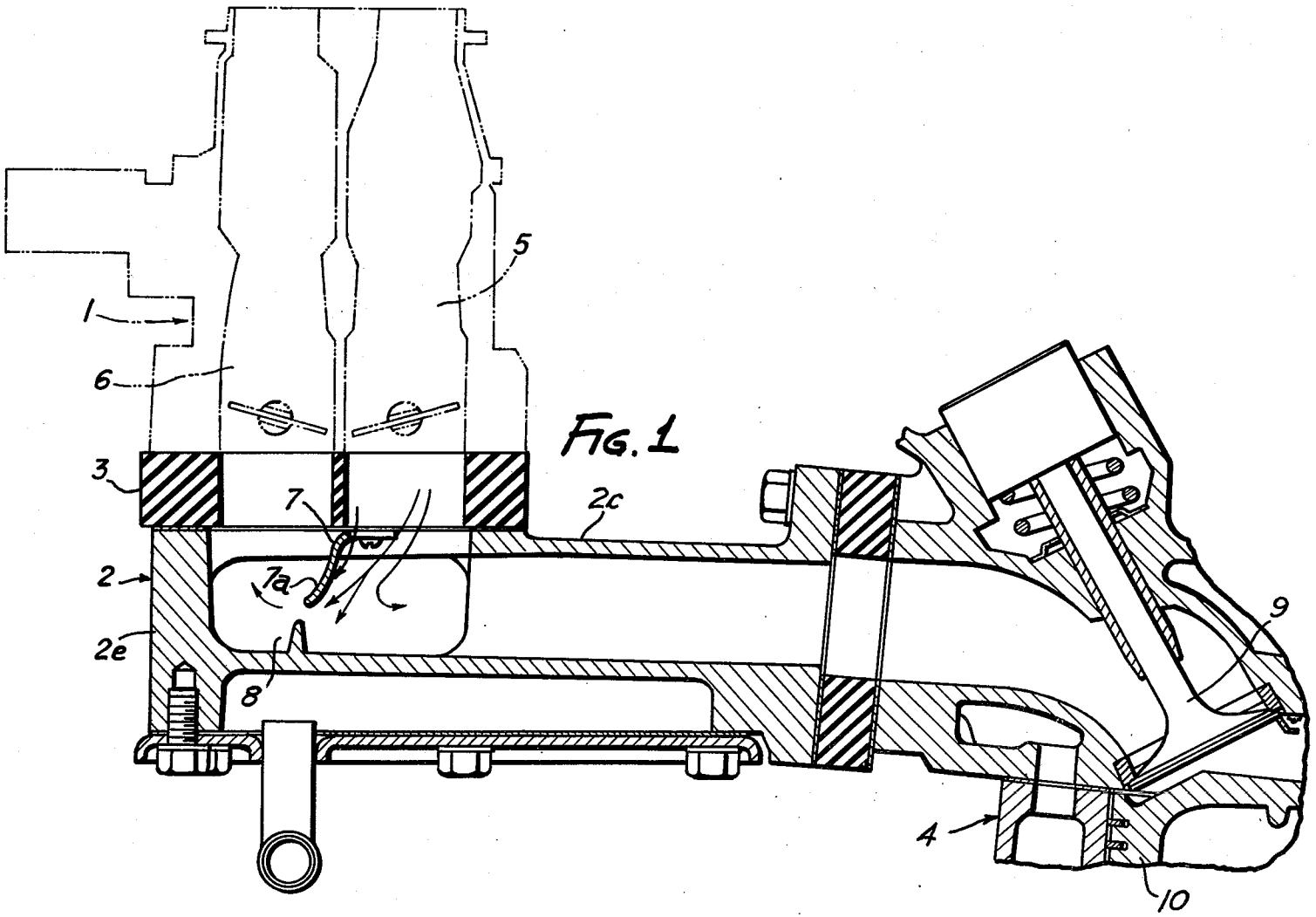
FIG. 1 is an axial section showing the presently-preferred embodiment of the invention.

Referring first to FIG. 1, a compound carburetor 1 is connected to an intake manifold 2 through a heat insulating member 3. Numeral 4 denotes cylinders of an internal combustion engine arranged in tandem fashion.

Figure 2:
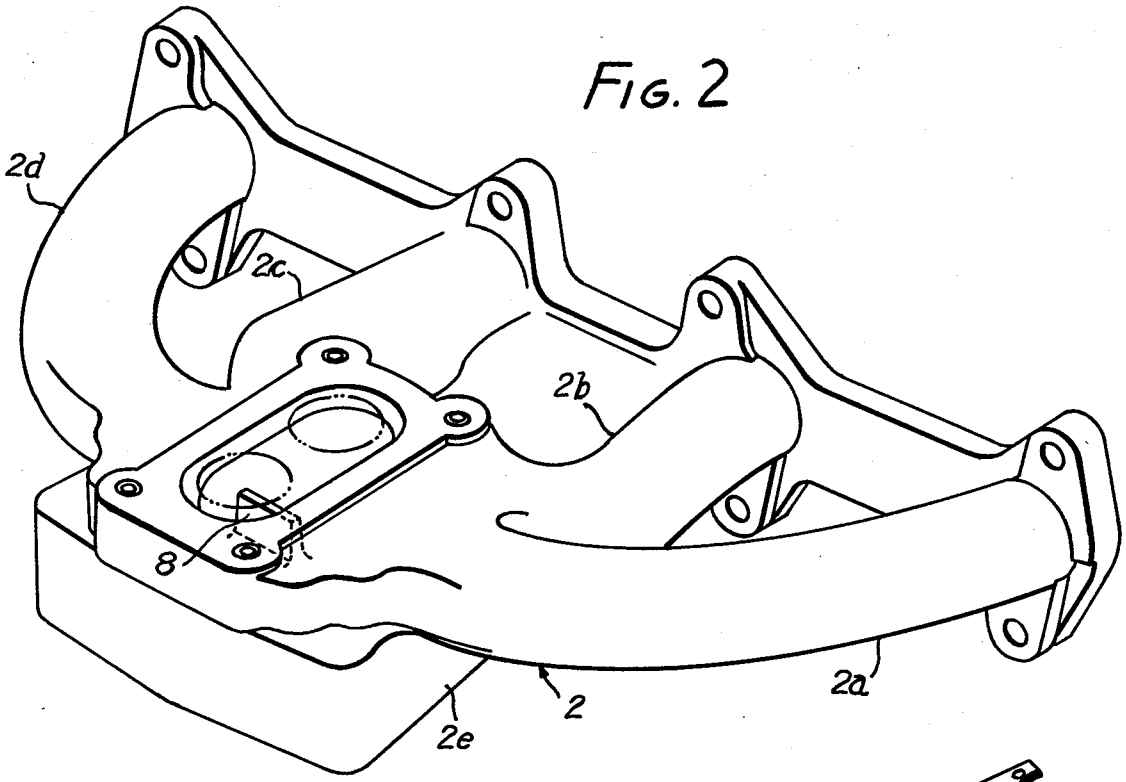
FIG. 2 is a perspective view of the intake manifold of FIG. 1.
Figure 3:
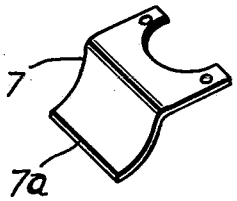
FIG. 3 is a perspective view of the rectifying plate in FIG. 1.

As will be seen also from FIG. 2, the carburetor 1 and the heat insulating member 3 have primary and secondary intake passages 5, 6 respectively, which are independent from each other. The primary intake passage 5 is located closer to the cylinders 4. The intake manifold 2 connected to the downstream side end of the heat insulating member 3 has a floor portion 2*e* from which four branch pipes extend. The central two branch pipes 2*b*, 2*c* extending laterally are relatively short, while relatively long branch pipes 2*a*, 2*d* curve away rearwardly and forwardly. Branch pipes 2*a* to 2*d* are connected to respective cylinders 4. The heat insulating member 3 has a wall separating the intake passages 5 and 6 from each other. A rectifying plate 7 is connected to the bottom of the wall, and extends downwardly therefrom. As will be clearly seen in FIG. 3, rectifying plate 7 is positioned to confront the central two branch pipes 2*b* and 2*c*, and has a lower end bent away from the cylinders 4. A rectifying projection 8 is provided on the floor 2*e* of the intake manifold 8, confronting the rectifying plate 7 and suitably spaced from the latter, leaving a gap between them. In FIG. 1, numerals 9 and 10 denote an intake valve and a piston.

The rectifying plate is sometimes called an "induction flow guide device".

In theinduction system constructed as described above, air/fuel mixture is supplied to the cylinders 4 corresponding to the central branch pipes 2*b*, 12*c*, by the suction vacuum of the primary intake passage 5. During this supply, the flow to the central two branch pipes 2*b*, 2*c* is restricted, due to a coanda effect of the rectifying plate 7, to deflect the intake flow along the curvature thereof, as shown by arrows. Consequently, the flow rate and richness of mixture directed to the central shorter branch pipes 2*b*, 2*c* is reduced, and becomes substantially equal to those in the other, longer, branch pipes 2*a*, 2*d*, despite the difference in lengths.

The rectifying projection 8 is intended for smoothening the flow of the mixture. It may be dispensed with. The size and shape of the rectifying plate can be optionally selected.

As has been described, the flow rate and air/fuel ratio (richness) of mixture to all cylinders are conveniently equalized, due to the deflecting function performed by the rectifying plate, so as to ensure a smooth operation of an engine.

This invention is not to be limited by the embodiments shown in the drawings and described in the description which are given by way of example and not of limitation, but only in accordance with the scope of the appended claims.

We claim:

1. In an engine induction system wherein a plurality of engine cylinders are supplied with air/fuel mixture by a compound carburetor having a separate primary and secondary intake passage through an intake manifold which has a plenum chamber that receives mixture from said two intake passages and distributes said mixture to the cylinders through respective branch pipes, said primary passage being closer to the cylinders than the secondary passage, and said plenum chamber having a floor opposite where the primary and secondary passages enter said plenum chamber, a first pair of said branch pipes departing from said plenum chamber closer to said primary intake passage than to said secondary intake passage an on the same side of said intake passage, a second pair of said branch pipes departing from said pleunum chamber relatively closer to said secondary intake passage than to said primary intake passage, on opposite sides of said intake passage from one another, the improvement comprising: a rectifying plate depending from the top of said plenum chamber between the primary and secondary passage, sloping downwardly and away from said first pair of branch pipes, with a clearance between its lower edge and said floor, and confronting said first pair of branch pipes, whereby to provide a coanda effect effect to reduce flow through said first pair of branch pipes and to encourage flow through said second pair of branch pipes.

2. Apparatus according to claim 1 in which a second rectifying plate extends upwardly from said floor, said clearance being formed between it and the lower edge of the other rectifying plate.

* * * * *